United States Patent [19]

Keenan

[11] Patent Number: 4,837,961

[45] Date of Patent: Jun. 13, 1989

[54] RECOIL ASSEMBLY FOR PUMP GUNS

[76] Inventor: James P. Keenan, P.O. Box 1243, Alfred, N.Y. 14802

[21] Appl. No.: 189,630

[22] Filed: May 3, 1988

[51] Int. Cl.[4] ..... F41C 23/00

[52] U.S. Cl. ..... 42/72

[58] Field of Search ..... 42/72, 71.01

[56] References Cited

U.S. PATENT DOCUMENTS

| | | | |
|---|---|---|---|
| 2,104,129 | 1/1938 | Kress . | |
| 2,331,372 | 10/1943 | Buchanan, Jr. . | |
| 2,547,180 | 4/1951 | Taylor . | |
| 2,771,697 | 11/1956 | Reising . | |
| 2,826,848 | 3/1958 | Davies . | |
| 3,442,042 | 5/1969 | Gilbert . | |
| 4,321,765 | 3/1982 | Gillum | 42/72 |
| 4,328,633 | 5/1982 | Pachmayr et al. . | |
| 4,502,238 | 3/1985 | Farrar et al. | 42/72 |
| 4,579,037 | 4/1986 | Gillum | 42/72 |

FOREIGN PATENT DOCUMENTS

| | | | |
|---|---|---|---|
| 925252 | 4/1947 | France | 42/72 |

*Primary Examiner*—Deborah L. Kyle
*Assistant Examiner*—Richard W. Wendtland
*Attorney, Agent, or Firm*—Christel, Bean & Linihan

[57] ABSTRACT

A recoil assembly which is adapted to be removably secured to a pump gun such as an assault shotgun. The recoil assembly includes a tubular slide handle, a body portion and a handle. The slide handle is mounted about the magazine tube for reciprocating movement thereof. The body portion is secured to the slide handle by mounting means so as to dispose the handle which is connected to the body portion directly above the barrel for gripping with the hand.

10 Claims, 1 Drawing Sheet

RECOIL ASSEMBLY FOR PUMP GUNS

FIELD OF THE INVENTION

This invention relates to pump-type guns, and more particularly to a recoil assembly adapted to be removably secured to the slide handle of an assault shotgun.

BACKGROUND OF THE INVENTION

A conventional pump gun such as a shotgun includes a slide handle element which is normally mounted at the underside of the gun barrel about the magazine tube and is manually reciprocated in a front to rear direction relative to the barrel to cock the gun and feed successive rounds of ammunition to the firing chamber. In practice, the slide handle is customarily grasped in one hand facing upwardly and retracted or moved rearwardly and then forwardly. Commonly, various types of hand grips will project downwardly from the slide handle and under the barrel to ease the operation of the slide handle as previously described.

However, some pump-type guns are typically fired from the waist or hip. For example, when an assault shotgun is used, it is fired from the hip and in many cases, it is fired while the person controlling it is on the move. The standard slide that is on most shotguns is located under the barrel and parallel thereto. In order to grasp the slide for either control or to reload the weapon one must grasp it with the hand palm up, fingers up, and pull down and back. Gripping the slide in this fashion is not a natural gripping position for the hand when the gun is being fired from the hip. A more natural position which would facilitate strength and controllability would be grasping the slide palm down, fingers down, and pushing down and back. This would not be feasible with standard slide. Accordingly, it is awkward to fire an assault shotgun or the like from the hip, and the users controllability is reduced, especially, if firing on the run. Furthermore, grasping a handle attached to the slide and projecting downward therefrom would be difficult when the gun is positioned at the hip. Consequently a recoil assembly affording a user greater control and ease of use is needed for pump guns of the type fired from the waist or hip.

OBJECTS AND SUMMARY OF THE INVENTION

Accordingly, it is the object of the present invention to provide a recoil assembly which improves the controllability of pump-type guns such as assault shotguns.

It is another object of the present invention to provide a recoil assembly including a handle which is positioned above the barrel, which handle can be gripped with the palm down, fingers down, and pushed down and back.

It is a still further object of the present invention to provide a recoil assembly wherein the gripping section of the handle is crosswise to the barrel to provide a more stable base for control of the gun.

A yet further object of the present invention is to provide a recoil assembly which is sturdy, relatively easy to manufacture and adaptable for usage on pump-type guns such as an assault shotgun whether for the military, police, or home defense.

In accordance with the invention a recoil assembly is adapted to be removably secured to a pump gun such as a shotgun of the type having a magazine tube, a receiver defining a breech, a barrel having a rearward end fixedly connected to the receiver and defining a firing chamber that extends into the receiver. The recoil assembly includes a tubular slide handle, a body portion and a handle. The slide handle has recesses defining slots on each side thereof. The slide handle is adapted to be mounted about the magazine tube for reciprocating movement relative to the receiver end barrel between a forward firing position and a rearward retracted position. The body portion has a top section and a plurality of side-by-side legs projecting downwardly therefrom of a face-to-face relation to form a yoke. Attached to the top section of the body portion is a transverse handle with a gripping section. The handle is attached so as to dispose the gripping section directly above the barrel for gripping with the hand palm down, fingers down, and to be manually reciprocated by pushing down and back thereby reciprocating the slide handle relative to the receiver and barrel.

The above will become more apparent to those skilled in the art after a consideration of the following detailed description taken in conjunction with the accompanying drawings in which a preferred form of this invention is illustrated.

DESCRIPTION OF THE PREFERRED EMBODIMENT

Figures 1, 2, 3, 4, 5:
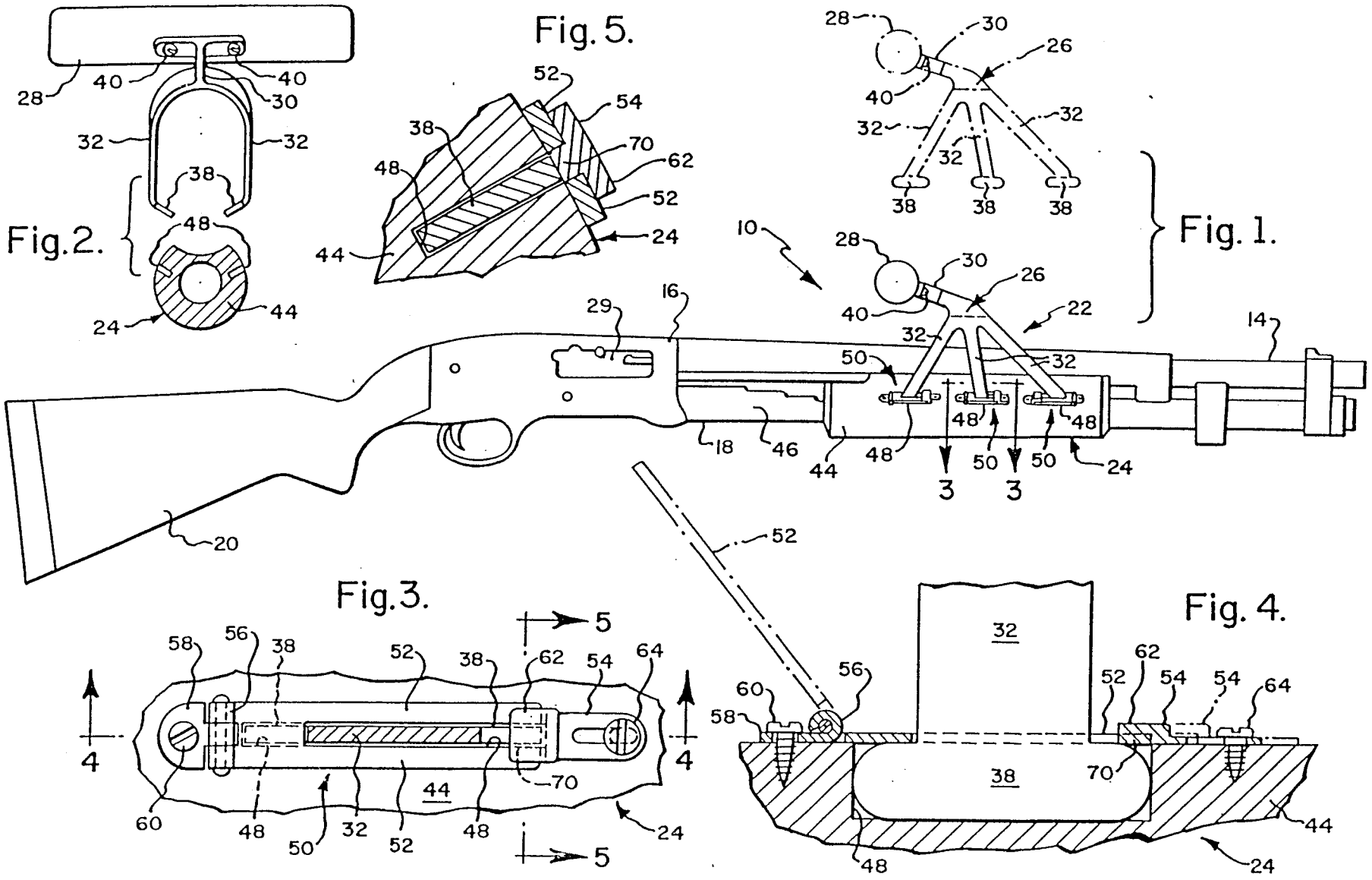
FIG. 1 is a side elevational view of a shotgun which has been modified to receive the recoil assembly of this invention comprising a slide handle, body portion and handle, the recoil assembly being shown in its assembled position in full lines, and the body portion and handle of the recoil assembly in its disassembled position in broken lines.
FIG. 2 is an end view of the slide handle shown in FIG. 1 with the handle and body portion shown in a disassembled relationship to the shotgun slide which is shown in cross section.
FIG. 3 is a cross sectional view through one of the legs of the body portion showing the manner in which the body portion is secured to the slide handle.
FIG. 4 is a section taken generally along the line 4—4 in FIG. 3 and showing the hinged retaining element in its assembled position in full lines and in its disassembled position in broken lines.
FIG. 5 is a section taken generally along the line 5—5 in FIG. 3.

Referring first to FIG. 1, there is shown a shotgun of the pump-type, generally indicated 10, which may in most respects be of conventional construction, the shotgun including trigger 12 to fire a shotgun shell received in the rear portion of barrel 14 which is connected at its rear end to receiver 16 and projects forwardly therefrom. A magazine tube 18 extends forwardly from the receiver 16 and is disposed directly beneath barrel 14 and parallel thereto, the magazine tube being adapted to contain a series of shotgun shells which are successively fed rearwardly from the tube 18 into the receiver 16 for delivery to the barrel. A stock 20 extends from the rear end of receiver 16, the butt of the stock normally being positioned at the user's shoulder or hip when firing the shotgun 10.

In accordance with the present invention, a recoil assembly is provided, which assembly is indicated generally at 22. The assembly includes a slide handle 24, a body portion indicated generally at 26, and a handle 28.

The rearward reciprocation of the slide handle 24 functions to actuate the firing mechanism (not shown) and to eject a spent shell from the receiver 16 through a side opening 29. The forward reciprocation of the slide handle 24 feeds the next successive shell to the barrel, followed by the automatic closure of the rear end of the barrel in preparation for firing the shell by pulling the trigger 12.

The body portion 26 of the recoil assembly includes a top section 30 and three pairs of opposed downwardly extending legs bowed 32 projecting away from the top section 30 in a face-to-face relation to form a yoke. The yoke configuration is best seen in FIG. 2. The three pairs of opposed downwardly extending legs bowed are of sufficient length so that sighting above the barrel 14 and below top section 30 of the body portion 26 is possible. As seen in FIG. 1, the legs 32 comprise a front pair of legs, an intermediate pair of legs and a rear pair of legs. The rear pair of legs are shorter in length than the front pair of legs so as to provide a backward angle on the recoil assembly body portion and handle so as to facilitate easier grasping and use.

Each of the legs 32 is provided with feet 38 which project perpendicularly from the legs 32 in a direction parallel to the magazine tube 18 and barrel 14. As will become apparent, the feet 38 may be received within slots in the slide handle 24 so that the body portion 26 may be secured to the slide handle 24.

The handle 28 is mounted to the top section 30 of body portion 26 by conventional screws 40. The handle 28 comprises a gripping section. When the shotgun 10 is positioned at the hip, the handle 28 is positioned above barrel 14 and magazine tube 18 and is perpendicular thereto. The handle defines a cross grip that the user can grasp with the entire width of the hand.

With reference again to FIG. 1, there is shown a tubular slide handle 24 modified in accordance with the present invention. The slide handle 24 is mounted in a conventional manner about magazine tube 18 and is manually reciprocal along the tube 18. The slide handle 24 includes a tube 44 which is internally and externally cylindrical and is mounted on the outer cylindrical surface 46 of magazine tube 18 to guide slide handle 24 for the desired forward and rearward reciprocation along magazine tube 18. The tubular slide handle 24 further comprises recesses which define slots 48 therein which are parallel to magazine tube 18, the slot receiving feet 38 of body portion 26. The slide handle 24 includes one slot for each foot 38 of body portion 26. The slide handle 24 further includes fastening means, indicated generally at 50, there being a fastening means 50 associated with each slot to securely hold the associated foot 38 within the associated slot 48. As best shown in FIG. 3, the fastening means 50 includes a hinged slotted door 52 and a slide member 54. An end 56 of each door 52 is pivotally secured to hinge 58, which is in turn secured to tube 44 by a conventional screw 60 adjacent the end of the associated slot 48. The slide member 54 is mounted adjacent the other end of the associated slot 48, which slide member can overlie a portion of the associated slot to hold the door 52 in a closed position. Thus, the slide member 54 overlies end 62 of door 52 thereby keeping door 52 securely fastened when the locking screw 64 is tightened.

With reference to FIG. 5, there is illustrated a front sectional view of slide member 54. The slide member 54 as seen has a T-shaped configuration. The lower portion of the T, when in its assembled position, that is overlying door end 62 (FIG. 3), snugly fits against foot 38 as shown at 70.

In accordance with the present invention, foot 38 is received within the associated slot 48 and then slotted door 52 is moved from an open position (shown in phantom lines) 64 to a closed position (shown in full lines) 66 so as to receive leg 32 within the slot of door 52 as best seen in FIG. 3. Then slide member 60 is positioned to overlie door 52, as shown in FIG. 5, and screw 64 may be tightened to hold slide member 60 snugly against door 52, thereby securely holding foot 38 within the associated slot.

While a specific embodiment of the present invention has been disclosed as typical, the invention is of course not to be limited to these particular forms but rather is applicable broadly to all such variations as fall within the scope of the appended claims. Therefore, although six legs are depicted in the description of the preferred embodiment, it is to be understood that differing numbers of legs with associated slots and fastening means can be employed without diverging from the scope of the present invention. Also, while the preferred structure shows and describes one form of a modified slide handle for receiving and securing the body portion thereto, this invention is not to be limited to the particular details shown and described above. Thus, widely differing means may be employed in securing the body portion to the slide handle.

What is claimed is:

1. A recoil assembly adapted to be removably secured to a pump gun of the type having a reciprocal magazine tube disposed below a barrel, said assembly comprising:

a body portion having a top section and at least one pair of opposed downwardly extending legs projecting away from said top section in a face-to-face relation to form a yoke;

a handle mounted on the top section of the body portion, the handle having a gripping section of sufficient size for the gripping thereof with either a gloved or ungloved hand;

a tubular slide handle adapted to be mounted about the magazine tube for reciprocating movement relative to the barrel between a forward firing position and a rearward retracted position; and fastening means carried by the slide handle for removably fastening the lower portion of each leg of said body portion to said slide handle whereby the gripping section of the handle is disposed directly above the barrel for manual reciprocating of said slide handle by gripping said gripping section above the barrel with a hand and moving the hand in either a forward or rearward direction.

2. The recoil assembly as set forth in claim 1, wherein three pairs of opposed downwardly extending legs are provided.

3. The recoil assembly as set forth in claim 2 wherein the rear pair of legs is shorter in length than the front pair of legs so as to provide a backward angle on the recoil assembly to facilitate easier use.

4. The recoil assembly as set forth in claim 1 wherein each of said legs is bowed of a sufficient length and in such a manner that sighting above the barrel and below the top section of the body portion is possible.

5. The recoil assembly as set forth in claim 1 wherein the lower portion of each of the legs is provided with a foot, wherein slots are provided on the tubular slide handle, there being one slot for each foot, and wherein one fastening means is associated with each slot for securing the feet within the associated slots.

6. The recoil assembly as set forth in claim 5 wherein the feet and slots project in a direction parallel to the magazine tube.

7. The recoil assembly as set forth in claim 5 wherein each of the fastening means includes a hinged slotted door, one end of each door being pivotally secured to the slide handle adjacent one end of an associated slot, each of the fastening means further including holding means disposed adjacent the other end of the associated slot and capable of engaging the other end of the door to hold the door in its closed position whereby the door overlies the associated slot to hold the associated foot within the associated slot.

8. The recoil assembly as set forth in claim 7 wherein the holding means is a slide carried by the slide handle.

9. A recoil assembly adapted to be removably secured to a pump gun of the type having a reciprocal magazine tube disposed below a barrel, said assembly comprising:

a body portion having a top section and at least two pairs of opposed downwardly extending legs interconnected to the top section and projecting away from said top section in a face-to-face relation to form a yoke, the lower end of each of the legs being provided with a foot, and wherein said legs are bowed of sufficient length and in such a manner so as to facilitate sighting above the barrel and below the top section of the body portion;

a handle mounted on the top section of the body portion, the handle having a gripping section of sufficient size for the gripping thereof with either a gloved or ungloved hand; a tubular slide handle adapted to be mounted about the magazine tube for reciprocating movement relative to the barrel between a forward firing position and a rearward retracted position, the slide handle having one slot for each foot; and fastening means carried by the slide handle, there being one fastening means associated with each of the slots for removably securing the feet of the body portion to said slide handle whereby the gripping section of the handle is disposed directly above the barrel for manual reciprocating of said slide handle by gripping said gripping section above the barrel with a hand and moving the hand in either a forward or rearward direction.

10. The recoil assembly of claim 9, wherein each of the fastening means further includes a hinged slotted door, one end of each door being pivotally secured to the slide handle adjacent one end of the associated slot, and wherein each of the fastening means further includes a slide carried by the slide handle associated with each slot and capable of engaging the other end of the associated door to hold the door in its closed position wherein it overlies the associated slot to hold the associated foot within the associated slot.

* * * * *